US007336166B2

(12) United States Patent
Akamatsu

(10) Patent No.: US 7,336,166 B2
(45) Date of Patent: Feb. 26, 2008

(54) REMOTE MONITORING SYSTEM AND METHOD USING THE SAME

(75) Inventor: Kenji Akamatsu, Osaka (JP)

(73) Assignee: Funai Electric Co., Ltd. (JP)

( * ) Notice: Subject to any disclaimer, the term of this patent is extended or adjusted under 35 U.S.C. 154(b) by 100 days.

(21) Appl. No.: 11/208,562

(22) Filed: Aug. 23, 2005

(65) Prior Publication Data

US 2006/0055528 A1 Mar. 16, 2006

(30) Foreign Application Priority Data

Aug. 24, 2004 (JP) ..... 2004-244358

(51) Int. Cl.
*G08B 29/00* (2006.01)

(52) U.S. Cl. ..... 340/506; 340/573.1; 340/531; 379/38; 379/40; 379/44; 379/45; 379/46

(58) Field of Classification Search ..... 340/573.1, 340/573.4, 506, 531; 379/37–46
See application file for complete search history.

(56) References Cited

U.S. PATENT DOCUMENTS 5,936,530 A * 8/1999 Meinhold ..... 340/573.1
2002/0107958 A1* 8/2002 Faraldo ..... 709/224
2005/0275541 A1* 12/2005 Sengupta et al. ..... 340/573.1

* cited by examiner

*Primary Examiner*—Jeffery Hofsass
*Assistant Examiner*—Hongmin Fan

(74) *Attorney, Agent, or Firm*—Bacon & Thomas, PLLC

(57) ABSTRACT

The invention provides a remote monitoring system which has a simplified configuration and is capable of remotely monitoring the current state of a person needing care and detecting an abnormality in the person's behavior and then addressing the abnormality, and further provides a method using the remote monitoring system. The remote monitoring system comprises: a communication line 3 for sending information indicating occurrence of an abnormality from a security device 1 to a terminal device 2 via an email support line and a telephone line; a central processing unit 11 for detecting that a user at said terminal device does not acquire the information indicating occurrence of an abnormality until a first predetermined time period has passed since the security device began sending the information indicating occurrence of an abnormality and sending out a first detection signal, and for detecting that the user at said terminal device does not acquire the information indicating occurrence of an abnormality until a second predetermined time period has passed since expiration of said first predetermined time period and sending out a second detection signal; detection means consisting of a detection circuit 16, etc.; control means consisting of the central processing unit 11 and a communication control unit 15, etc., and provided for allowing the communication line 3 to provide the email support line until the first predetermined time period has passed since the information indicating occurrence of an abnormality began to be sent and to provide the telephone line in response to the first detection signal; and an alarm generation unit 17, provided in the security device 1, for generating a first alarm in response to the first detection signal and generating a second alarm, which rings louder than the first alarm does, in response to the second detection signal.

4 Claims, 4 Drawing Sheets

REMOTE MONITORING SYSTEM AND METHOD USING THE SAME

BACKGROUND OF THE INVENTION

1. Field of the Invention

The present invention relates to a remote monitoring system comprising a security device for acquiring information indicating occurrence of an abnormality and addressing the abnormality in the event the information is not successfully acquired by a user at a terminal device to which the information is sent by transmission means and to a method using such a remote monitoring system.

2. Description of the Related Art

In recent years, a system allowing communication between a monitoring device and individual terminal devices has been widely employed. Whether or not information is successfully received by a recipient depends on whether a terminal device user as an information recipient has confirmed reception of the information and therefore such communication with the terminal device is one way communication. In such a system, secure transmission of information from the monitoring device is not guaranteed. To prevent such a problematic situation, a prior art technique disclosed in Patent document 1 has been proposed. A system according to the prior art technique comprises a monitoring device for causing monitoring equipments to detect an abnormality and collecting information indicative of the abnormality, transmission means for sending the information collected by the monitoring device via a transmission line such as the Internet in the form of an email to a particular terminal device having a specific email address, reception means for receiving a return email from said terminal device, processing means for processing information contained in the email received, and means for continuing to send said email until said monitoring device receives an acknowledgement to said email from said terminal device.

Further, as another conventional technique, a system disclosed in Patent document 2 has been proposed. The system is a home health care system for monitoring the activities of individuals such as an elderly person living alone within their homes, in which a home care system provided in a house of a person to be cared determines whether the person has an abnormality. Information indicative of the abnormality is sent to a server in a centralized communications center and then sent from the server to service personnel such as a home helper. The service personnel who received the information checks by telephone if the person needing care is in good/poor health or alternatively visits a person's home and checks out the person's state of health. However, there is a far more problematic situation in which the information indicative of the abnormality is sent in one way direction from the server to the service personnel and therefore whether or not the service personnel has successfully received the information and checked out the person's state of health cannot be identified. In order to solve such a problem, the system is configured so that the service personnel reports to a processing unit that he/she has successfully received the information and checked out the person's state of health, and when the personnel does not report for a predetermined time period, the system automatically urges the personnel to report. More specifically, the home health care system detects an abnormality in the person needing care and sends information indicating the abnormality and including a subject code to the processing unit via a communication network. The processing unit identifies a service personnel based on the subject code and sends the information indicating the abnormality to the personnel by cellular phone, etc. The service personnel provides treatment to the person needing care based on the received information indicating the abnormality and sends a result of the treatment to the processing unit. Then, when the processing unit does not receive the result of the treatment after the predetermined time period has passed, the unit automatically places a call to the personnel's phone and urges the personnel to report the result. In a case where the information indicating the abnormality is not successfully received by the personnel, a backup center operating 24 hours a day eventually provides treatment to the person needing care.

[Patent Document 1]

Japanese Unexamined Patent Publication No. 2003-78904 (paragraphs [0008], [0010], [0020])

[Patent Document 2]

Japanese Unexamined Patent Publication No. 2003-178383 (paragraphs [0016] to [0019], [0026] to [0037])

However, the conventional techniques disclosed in the above Patent document 1 and Patent document 2 have the following problems. That is, when information indicating occurrence of an abnormality is not successfully received by the terminal device, the information is repeatedly sent to the terminal device and if the information is not eventually received by the terminal device, the abnormality is left untreated or noticed too late. Naturally, as above described with reference to the conventional technique disclosed in Patent document 2, it is also contemplated that the backup center operating 24 hours a day is provided. However, provision and management of such a backup center requires a large sized-piece of apparatus and a large space for the apparatus, and the involvement of administrators, increasing investment cost and making the approach to providing the backup center unpractical.

In consideration of the abovementioned problems found in the conventional techniques, the invention provides a remote monitoring system which has a simplified configuration and is capable of remotely monitoring the current state of a person needing care and detecting an abnormality in the person's behavior and then addressing the abnormality. The invention further provides a method using the remote monitoring system.

SUMMARY OF THE INVENTION

In order to solve the aforementioned problems, a remote monitoring system as claimed in claim 1 of this application is provided for sending information indicating occurrence of an abnormality and collected by a security device to a predetermined terminal device, in order to remotely monitor whether or not there is an abnormal situation, and is characterized in that the system comprises: communication means (e. g., consisting of a communication line 3, a communication control unit 15, etc.) for sending said information indicating occurrence of an abnormality from said security device to said terminal device via an email support line and a telephone line; detection means (e. g., consisting of a central processing unit 11, a detection circuit 16, etc.) for detecting that a user at said terminal device does not acquire said information indicating occurrence of an abnormality until a first predetermined time period has passed since said security device began sending said information indicating occurrence of an abnormality and sending out a first detection signal, and for detecting that the user at said terminal device does not acquire said information indicating occurrence of an abnormality until a second predetermined time period has passed since expiration of said first predetermined time period and sending out a second detection signal; control means (e. g., consisting of a central processing unit 11, a communication control unit 15, etc.) for allowing said communication means to provide said email support line until said first predetermined time period has passed since said information indicating occurrence of an abnormality began to be sent and to provide said telephone line in response to said first detection signal; and alarm generation means (alarm generation unit 17), provided in said security device, for generating a first alarm in response to the first detection signal and generating a second alarm, which rings louder than the first alarm does, in response to said second detection signal.

Further, a remote monitoring system as claimed in claim 2 of this application is provided for sending information indicating occurrence of an abnormality and collected by a security device to a predetermined terminal device, in order to remotely monitor whether or not there is an abnormal situation, and is characterized in that the system comprises: communication means (e. g., communication line 4) for sending an email containing said information indicating occurrence of an abnormality from said security device to said terminal device; detection means (e. g., consisting of a central processing unit 11, a detection circuit 161, etc.) for detecting that the email is not opened at said terminal device until a first predetermined time period has passed since said security device began sending said email and sending out a first detection signal, and for detecting that said email is not opened at said terminal device until a second predetermined time period has passed since expiration of said first predetermined time period and sending out a second detection signal; and alarm generation means (e. g., alarm generation unit 17), provided in said security device, for generating a first alarm in response to the first detection signal and generating a second alarm, which rings louder than the first alarm does, in response to said second detection signal.

Further, a remote monitoring method as claimed in claim 3 of this application is provided for sending information indicating occurrence of an abnormality and collected by a security device to a predetermined terminal device, in order to remotely monitor whether or not there is an abnormal situation, and is characterized in that the method comprises: a step (e. g., consisting of step S1 to step S3) of sending an email containing said information indicating occurrence of an abnormality to said terminal device; a step (e. g., step S5) of determining whether or not said email is opened at said terminal device until a first predetermined time period has passed since said security device began sending said email; a step (e. g., consisting of step S10 and step S11) of sending said information indicating occurrence of an abnormality to said terminal device via a telephone line in the event said email is not opened until said first predetermined time period has passed; a step (e. g., step S12) of allowing an alarm generation unit provided in said security device to generate a first alarm after said first predetermined time period has passed; a step (e. g., consisting of step S13 and step S15) of determining whether or not the user acquires said information indicating occurrence of an abnormality and sent via said telephone line until a second predetermined time period has passed since expiration of said first predetermined time period; and a step (e. g., step S16) of allowing said alarm generation unit to generate a second alarm, which rings louder than the first alarm does, in the event the user does not acquire said information indicating occurrence of an abnormality and sent via said telephone line until said second predetermined time period has passed.

Moreover, a remote monitoring method as claimed in claim 4 of this application is provided for sending information indicating occurrence of an abnormality and collected by a security device to a predetermined terminal device, in order to remotely monitor whether or not there is an abnormal situation, and is characterized in that the method comprises: a step (e. g., consisting of step S21 to step S23) of sending an email containing said information indicating occurrence of an abnormality to said terminal device; a step (e. g., step S25) of determining whether or not said email is opened at said terminal device until a first predetermined time period has passed since said security device began sending said email; a step (e. g., step S31) of allowing an alarm generation unit provided in said security device to generate a first alarm after said first predetermined time period has passed in the event said email is not opened until said first predetermined time period has passed; a step (e. g., consisting of step S32 and step S33) of determining whether or not said email is opened and then said information indicating occurrence of an abnormality is acquired by a user until a second predetermined time period has passed since expiration of said first predetermined time period; and a step (e. g., step S34) of allowing said alarm generation unit to generate a second alarm, which rings louder than the first alarm does, in the event said email is not opened and said information indicating occurrence of an abnormality is not acquired by a user until said second predetermined time period has passed.

EFFECTS OF THE INVENTION

According to the various aspects of the invention having the above configuration, the remote monitoring system according to claim 1 for sending information indicating occurrence of an abnormality and collected by a security device to a predetermined terminal device, in order to remotely monitor whether or not there is an abnormal situation has the following features: (1) If the email is not opened at the terminal device even when the first predetermined time period has passed since the security device sent the email upon occurrence of an abnormality, the information indicating occurrence of an abnormality is sent as a voice message via a telephone line of the communication means in response to said first detection signal output from said detection means while the first alarm is generated by the alarm generation unit of the security device; (2) If a handset of the telephone is not picked up at the terminal device even when the second predetermined time period has passed since expiration of the first predetermined time period, the second alarm, which rings louder and indicates more distinctly the occurrence of an abnormality than the first alarm does, is generated in response to said second detection signal output from said detection means; (3) Accordingly, if the email is not opened at the terminal device even when the email is repeatedly sent to said terminal device, the information indicating occurrence of an abnormality is sent via the telephone line instead of the email support line in order to inform the user of occurrence of an abnormality and therefore the user finds without fail that the information has been sent; (4) Simultaneously, the security device generates an alarm to prevent an intruder from entering an area needing security and serves to inform a third party around the security device that an abnormality occurs; (5) As a result, the invention as claimed in claim 1 prompts a user to open the email in order to inform the user of occurrence of an abnormality and further increases the volume of an alarm sound after a predetermined time period has passed, allowing the alarm to be more effective for addressing the abnormality; (6) Moreover, the invention has a cost advantage in that only a slight change is made to the configuration of an existing remote monitoring system in order to provide the inventive remote monitoring system.

The remote monitoring system according to claim 2 for sending information indicating occurrence of an abnormality and collected by a security device to a predetermined terminal device, in order to remotely monitor whether or not there is an abnormal situation has the following features: (1) If the email is not opened at the terminal device even when the first predetermined time period has passed since the security device sent the email upon occurrence of an abnormality, the alarm generation unit of the security device generates the first alarm in response to said first detection signal output from said detection means; (2) If the email is not yet opened at the terminal device even when the second predetermined time period has passed since expiration of the first predetermined time period, the second alarm, which rings louder and indicates more distinctly the occurrence of an abnormality than the first alarm does, is generated in response to said second detection signal output from said detection means; (3) In order to prompt the user to open the email, the email is repeatedly sent to said terminal device; (4) Simultaneously, the security device generates an alarm to prevent an intruder from entering an area needing security and serves to inform a third party around the security device that an abnormality occurs; (5) As a result, the invention according to claim 2 prompts a user to open the email in order to inform the user of occurrence of an abnormality and further increases the volume of an alarm sound after a predetermined time period has passed, allowing the alarm to be more effective for addressing the abnormality; (6) Moreover, the invention has a cost advantage in that only a slight change is made to the configuration of an existing remote monitoring system in order to provide the inventive remote monitoring system.

The remote monitoring method according to claim 3 for sending information indicating occurrence of an abnormality and collected by a security device to a predetermined terminal device, in order to remotely monitor whether or not there is an abnormal situation has the following features: (1) If the email is not opened at the terminal device even when the first predetermined time period has passed since the security device sent the email upon occurrence of an abnormality, the security device detects that event and sends the information indicating occurrence of an abnormality as a voice message via a telephone line of the communication means while the alarm generation unit of the security device generates the first alarm; (2) If a handset of the telephone is not picked up at the terminal device even when the second predetermined time period has passed since expiration of the first predetermined time period, the security device detects that event and causes the alarm generation unit to generate the second alarm, which rings louder and indicates more distinctly the occurrence of an abnormality than the first alarm does; (3) Accordingly, if the email is not opened at the terminal device even when the email is repeatedly sent to said terminal device, the information indicating occurrence of an abnormality is sent via the telephone line instead of the email support line in order to inform the user of occurrence of an abnormality and therefore the user finds without fail that the information has been sent; (4) Simultaneously, the security device generates an alarm to prevent an intruder from entering an area needing security and serves to inform a third party around the security device that an abnormality occurs; (5) As a result, the invention according to claim 3 prompts a user to open the email in order to inform the user of occurrence of an abnormality and further increases the volume of an alarm sound after a predetermined time period has passed, allowing the alarm to be more effective for addressing the abnormality.

The remote monitoring method according to claim 4 for sending information indicating occurrence of an abnormality and collected by a security device to a predetermined terminal device, in order to remotely monitor whether or not there is an abnormal situation has the following features: (1) If the email is not opened at the terminal device even when the first predetermined time period has passed since the security device sent the email upon occurrence of an abnormality, the security device detects that event and causes the alarm generation unit to generate the first alarm; (2) If the email is not yet opened at the terminal device even when the second predetermined time period has passed since expiration of the first predetermined time period, the security device detects that event and causes the alarm generation unit to generate the second alarm, which rings louder and indicates more distinctly the occurrence of an abnormality than the first alarm does; (3) In order to prompt the user to open the email, the email is repeatedly sent to said terminal device; (4) Simultaneously, the security device generates an alarm to prevent an intruder from entering an area needing security and serves to inform a third party around the security device that an abnormality occurs; (5) As a result, the invention according to claim 3 prompts a user to open the email in order to inform the user of occurrence of an abnormality and further increases the volume of an alarm sound after a predetermined time period has passed, allowing the alarm to be more effective for addressing the abnormality.

DETAILED DESCRIPTION OF THE PREFERRED EMBODIMENTS

Preferred embodiments of the invention will be explained below with reference to the accompanying drawings.

Figure 1:
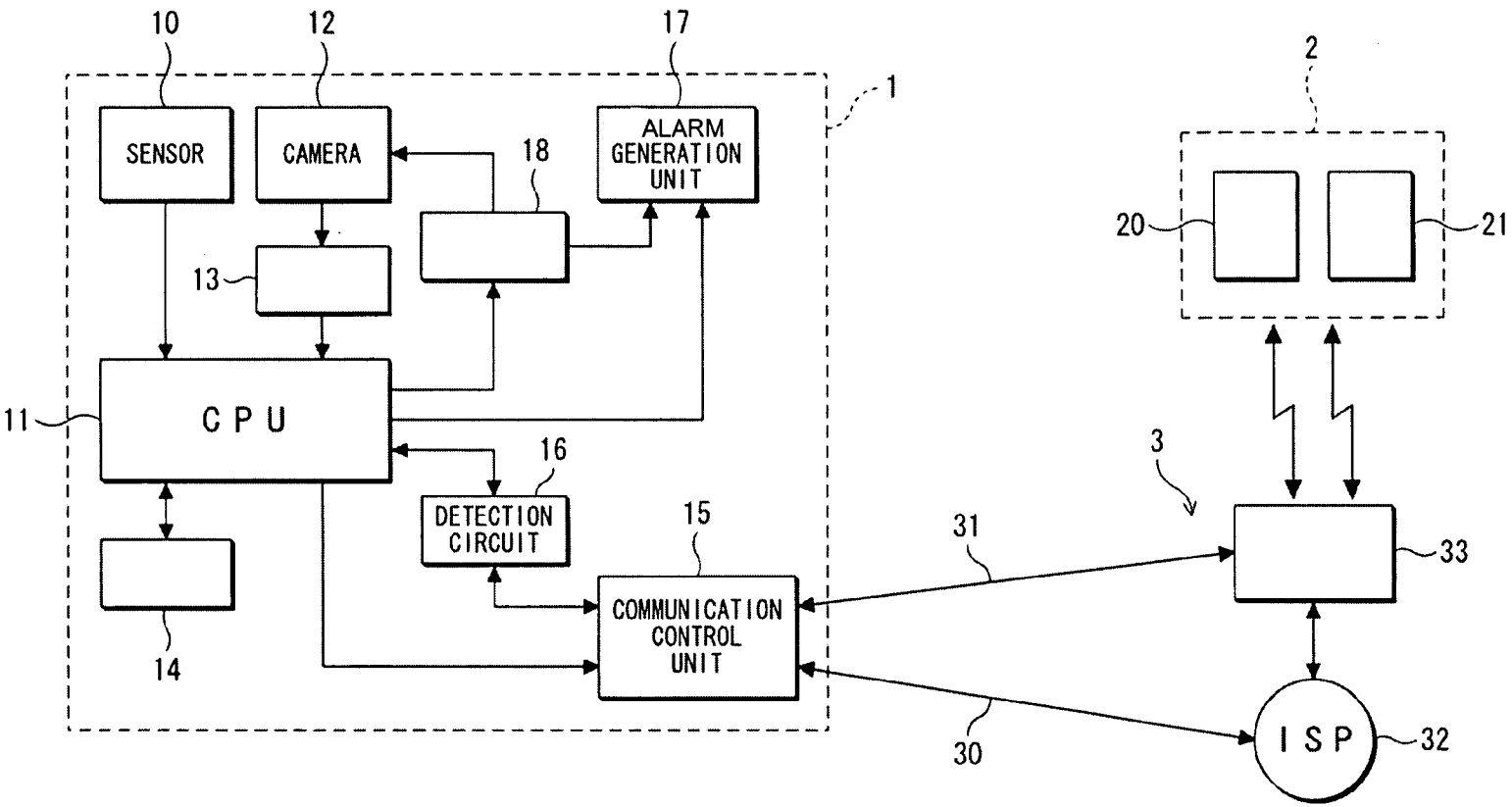
FIG. 1 is a block diagram showing an abnormal situation monitoring system according to the embodiment 1 of the invention.
Figure 2:
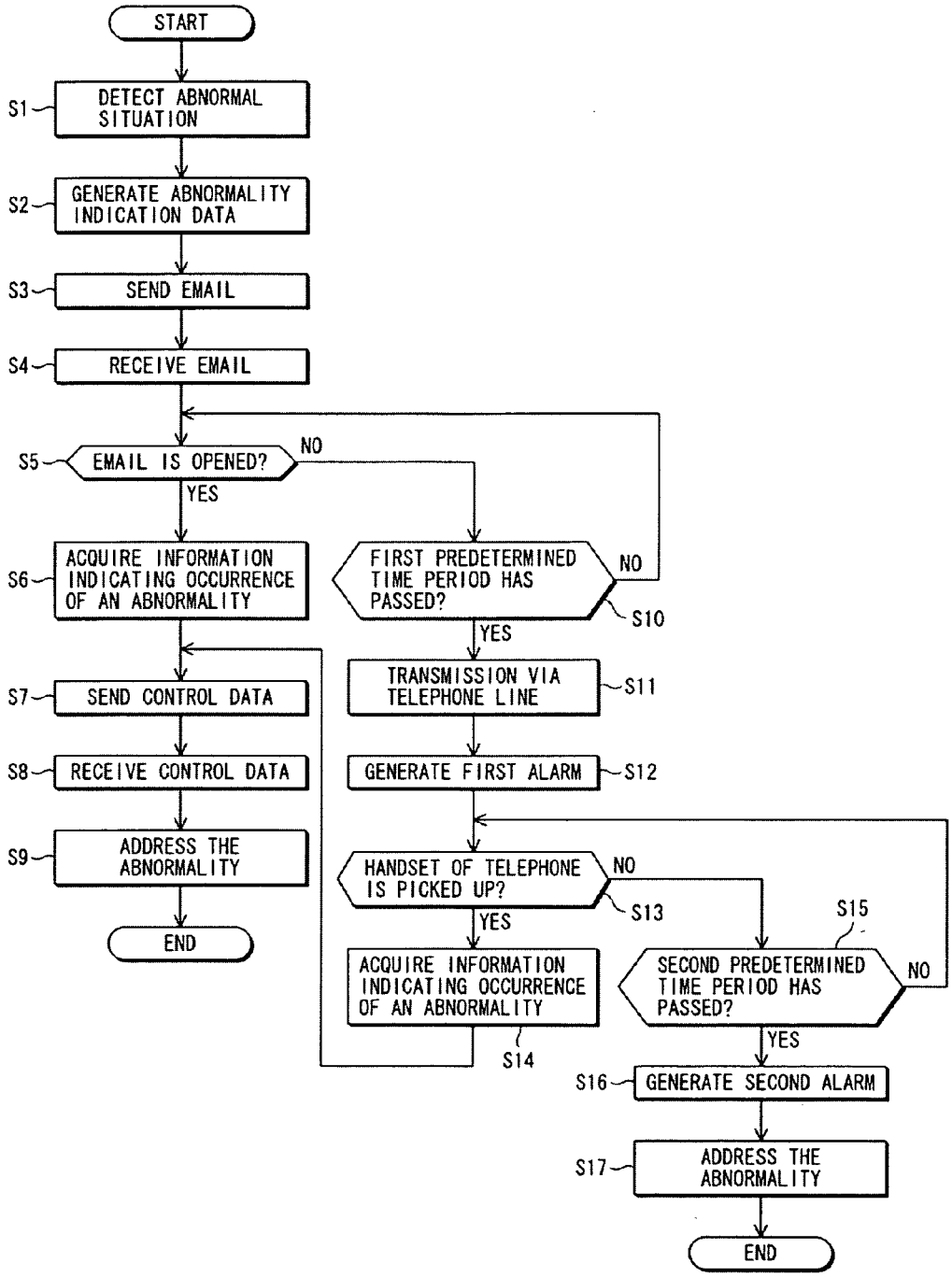
FIG. 2 is a flow chart showing how the abnormal situation monitoring system of FIG. 1 operates.

An embodiment 1 of the invention will be explained with reference to FIGS. 1 and 2. FIG. 1 is a block diagram showing a remote monitoring system according to the embodiment 1 of the invention and FIG. 2 is a flow chart showing how the remote monitoring system of FIG. 1 operates.

As shown in FIG. 1, the remote monitoring system comprises a security device 1, a terminal device 2, and a communication line 3 connecting the security device 1 and the terminal device 2, in which information indicating occurrence of an abnormality detected by the security device 1 is converted to abnormality indication data and the data is sent to the terminal device 2 via the communication line 3, thereby allowing the system to carry out remote monitoring.

After the terminal device 2 receives the abnormality indication data and a user acquires information indicating occurrence of an abnormality, the user sends control data via the communication line 3 to the security device 1, in order to control the security device 1.

The security device 1 comprises a sensor 10 for detecting an abnormality such as intrusion of a stranger, occurrence of fire, etc., a central processing unit 11 for generating abnormality indicator data in response to outputting of a signal indicating the abnormality detected by the sensor 10 and sending out the data to the communication line 3, a camera 12 for monitoring predetermined locations, and a conversion circuit 13 for converting an image signal generated by the camera 12 to digitized image data and supplying the data to the central processing unit 11. Numeral 14 designates an abnormality indicator data generation circuit in which abnormality indicator data is previously stored as an email message for email notification and as a voice message for telephone call. Further, the abnormality indicator data generation circuit 14 is operable to selectively output one of an email message and a voice message as abnormality indicator data in response to an instruction from the central processing unit 11.

The terminal device 2 comprises a personal computer 20 capable of communicating information via email and a telephone 21 capable of communicating information via a handset. The terminal device 2 may be intended to provide two functions as in the case of a cellular phone. Further, in the case of an email communication, two parties, i. e., the security device 1 and the terminal device 2 are identified by their email addresses and then information is communicated therebetween, and in the case of a telephone communication, the two parties are identified by their phone numbers and then information is communicated therebetween.

The communication line 3 comprises a line 30 (i. e., an email support line) for sending information/data as an email message and a line 31 (i. e., telephone communication line) for sending information/data as a voice message via a telephone call, in which the email support line 30 is connected via an Internet service provider 32 to a relay device 33 in a public network. The line 30 is an always-connected line.

The security device 1 is provided with a communication control unit 15 for selecting whether data is sent via the email support line 30 or the telephone communication line 31. Further, the security device 1 is provided with a detection circuit 16 which operates so that in the event a user at the terminal device 2 does not acquire the information indicating occurrence of an abnormality until a first predetermined time period has passed since the abnormality indicator data began to be sent, the detection circuit 16 detects this event and sends out a first detection signal and in the event the user does not acquire the information indicating occurrence of an abnormality until a second predetermined time period has passed since expiration of the first predetermined time period, the detection circuit detects this event and sends out a second detection signal. In the case of an email communication, the fact that the user at the terminal device 2 acquires the information indicating occurrence of an abnormality is indicated by a signal generated when the email is opened by the user and in the case of a telephone communication, the fact is detected when the line 31 becomes available.

The communication control unit 15 controls the communication line 3 so that the line 3 provides the email support line 30 until the first predetermined time period has passed since the information indicating occurrence of an abnormality began to be sent and then provides the telephone line 31 in response to the first detection signal from the detection circuit 16 when the first predetermined time period has passed. Further, though not shown, the communication control unit 15 includes a line switching circuit, a modem, etc.

The security device 1 is provided with an alarm generation unit 17. The alarm generation unit 17 generates a first alarm indicating occurrence of an abnormality in response to the first detection signal and a second alarm which in response to the second detection signal, rings louder and indicates more distinctly the occurrence of an abnormality than the first alarm does. For instance, the first alarm at normal volume is used to inform people around the security device 1 of occurrence of an abnormality and the second alarm at high volume is used to inform people far from the security device 1 of occurrence of an abnormality.

The terminal device 2 is used by a user to acquire the information indicating occurrence of an abnormality and send control data to the security device 1 in order to address the abnormality. The control data is determined by selecting one of the control contents previously prepared on an operation screen. The security device 1 is provided with a control circuit 18 for instructing the camera 12 to begin imaging in response to reception of the control data by the security device 1. Further, in response to the control data, the control circuit 18, if necessary, instructs the alarm generation unit 17 to generate an alarm.

Next, how the remote monitoring system according to the embodiment 1 of the invention operates will be explained with reference to a flow chart of FIG. 2. In step S1, the sensor 10 detects an abnormal situation and then in step S2, the abnormality indicator data generation circuit 14 generates an email message (or email letter) as abnormality indicator data and passes the email message to the central processing unit 11. In response to generation of the abnormality indicator data, the communication control unit 15 provides the email support line 30 as a communication line 3 in step S3. Then, the abnormality indicator data is sent by email to the personal computer 20 of the terminal device 2. The personal computer 20 receives the abnormality indicator data in step S4. Step S5 determines whether or not the email containing the abnormality indicator data received has been opened. When the email is opened and a user acquires information indicating occurrence of an abnormality in step S6, sending of the abnormality indicator data is stopped. Afterwards, the user sends from the personal computer 20 the control data on how to address the abnormality to the security device 1 in step S7. The security device 1 receives the control data in step S8. Then, the control circuit 18 enables the camera 12 to take the image of a location needing security in step S9. The image taken by the camera 12 is converted by the conversion circuit 13 to a digital image signal which is sent to the personal computer 20 via the email support line 30. The user views an image reproduced from the digital image signal on the personal computer 20 and is able to recognize the abnormal situation. In this manner, the user at the terminal device 2 acquires the information indicating occurrence of an abnormality and collected by the security device 1 and recognizes the abnormal situation, and therefore is able to address the abnormality.

When the user does not open the email in step S5 and the detection circuit 16 determines the first predetermined time period has passed in step S10, the communication control unit 15 provides the telephone communication line 31 as a communication line. Then, in step S11, the abnormality indicator data generation circuit 14 generates a voice message as abnormality indicator data and passes the voice message to the central processing unit 11, which in turn sends the voice message to the telephone 21 of the terminal device 2 via the telephone line 31. Afterwards, in step S12, the central processing unit 11 causes the alarm generation unit 17 to generate a first alarm. The first alarm is set at normal volume and used to inform people around the security device 1 of occurrence of an abnormality. At the terminal device 2, a call message is available by the telephone 21 and broadcast to the user.

In step S13, the detection circuit 16 determines whether or not a handset of the telephone 21 is picked up by the user. When speech communication begins, the detection circuit 16 detects the speech communication has begun and resets the time count of a timer to zero. The user retrieves the voice message over the telephone 21 and acquires the information indicating occurrence of an abnormality in step S14, and sends the control data by email from the personal computer 20 in step S7. The security device 1 receives the control data in step S8. Then, in step S9, the control circuit 18 causes the camera 12 to take the image of a location needing security. The image taken by the camera 12 is converted by the conversion circuit 13 to a digital image signal, which is again sent to the terminal device 2 via the email support line 31. The user at the terminal device 2 views an image reproduced from the digital image signal and is able to recognize an abnormal situation. If necessary, whether to allow the alarm generation unit 17 to continue or stop generating the first alarm is determined by the control data. In this manner, the user at the terminal device 2 acquires the information indicating occurrence of an abnormality and collected by the security device 1, and recognizes the contents of the abnormality, and therefore is able to address the abnormality.

When the detection circuit 16 detects the handset of the telephone 21 is not picked up by the user until the second predetermined time period has passed in step S15, the central processing circuit 11 instructs the alarm generation unit 17 to generate a second alarm in step S16. The second alarm rings much louder and more distinctly indicates occurrence of an abnormality than the first alarm does, in order to inform people far from the security device 1 of the occurrence of an abnormality. Afterwards, a situation in which a call message is available by the telephone 21 and broadcast to the user is maintained until the handset of the telephone 21 is picked up by the user and the situation is terminated when it is determined that the security device 1 has addressed the abnormality in step S17.

In the abovementioned embodiment 1, the abnormality is detected by the sensor 10 of the security device 1 and the abnormality indication data is sent by email to the terminal device 2, in order to allow the system to carry out remote monitoring. If the email is not opened at the terminal device 2 even after the first predetermined time period has passed since the security device 1 began sending the email in response to occurrence of an abnormality, the communication line 3 provides the telephone line 31 in response to the first detection signal output from the detection circuit 16 and the voice message is sent as abnormality indication data to the terminal device 2. Simultaneously, the alarm generation unit 17 of the security device 1 generates the first alarm. Then, if the handset of the telephone 21 is not picked up even when the second predetermined time period has passed since expiration of the first predetermined time period, the second alarm which in response to the second detection signal output from the detection circuit 16, rings louder and indicates more distinctly the occurrence of an abnormality than the first alarm does is generated. In this manner, when the email continues to be sent to the terminal device 2 and is not opened at the terminal device, instead of the email, the telephone is used as communication means to inform the user of the information indicating occurrence of an abnormality. Accordingly, the user finds without fail that the information has been sent. Further, the security device 1 generates an alarm to prevent an intruder from entering an area needing security and serves to inform a third party around the security device 1 that an abnormality has occurred. Moreover, an alarm increases in volume after a predetermined time period has passed, allowing the alarm to be more effective for addressing the abnormality.

Figure 3:
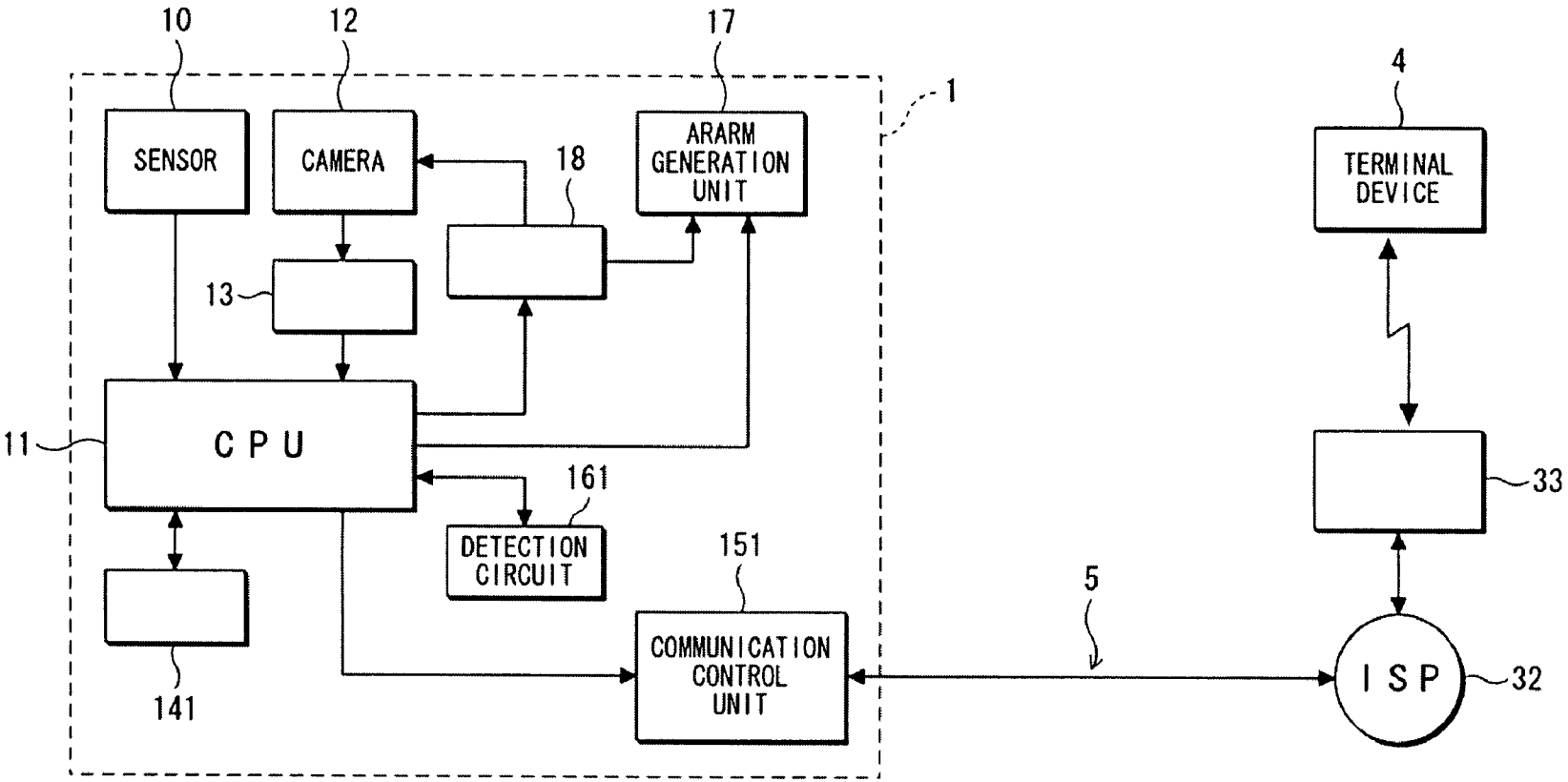
FIG. 3 is a block diagram showing the abnormal situation monitoring system according to the embodiment 2.
Figure 4:
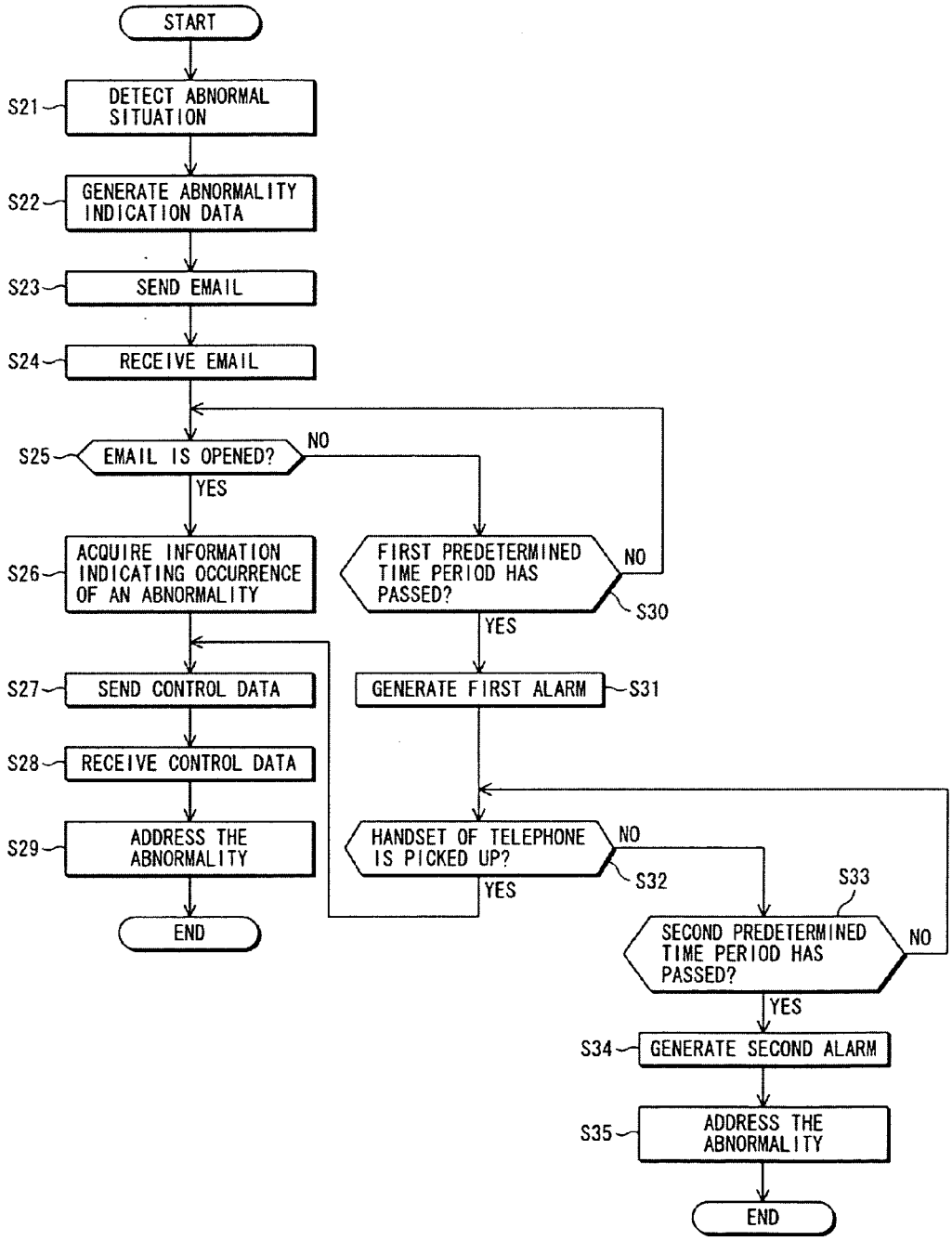
FIG. 4 is a flow chart showing how the abnormal situation monitoring system of FIG. 3 operates.

Embodiment 2 of the invention will be explained with reference to FIGS. 3 and 4. FIG. 3 is a block diagram of the remote monitoring system of the embodiment 2 of the invention and FIG. 4 is a flow chart showing how the system operates. In those figures, the same parts as those in the embodiment 1 of FIG. 1 are denoted with the same sign.

The remote monitoring system shown in FIG. 3 comprises a security device 1, a terminal device 4, and a communication line 5 connecting the security device 1 and the terminal device 4, in which an information indicating occurrence of an abnormality detected by the security device 1 is converted to abnormality indication data which is sent to the terminal device 4 via the communication line 5, thereby allowing the system to carry out remote monitoring. The terminal device 4 comprises a cellular phone capable of communicating information by email, a personal computer 20 and the like. After the terminal device 4 receives the abnormality indication data and a user acquires information indicating occurrence of an abnormality, the user sends control data via the communication line 5 to the security device 1 in order to control the device 1.

The security device 1 comprises a sensor 10 for detecting an abnormality such as intrusion of a stranger, occurrence of fire, etc., a central processing unit 11 for generating abnormality indicator data in response to a detection signal output from the sensor 10 and sending out the data to the communication line 5, a camera 12 for monitoring predetermined locations, and a conversion circuit 13 for converting an image signal generated by the camera 12 to digitized image data and supplying the data to the central processing unit 11. Numeral 141 designates an abnormality indicator data generation circuit in which abnormality indicator data is previously stored as an email message for email notification. Further, the abnormality indicator data generation circuit 141 is operable to generate and output abnormality indicator data as an email message in response to an instruction from the central processing unit 11. Further, in the case of an email communication, two parties, i. e., the security device 1 and the terminal device 2 are identified by their email addresses and then information is communicated therebetween.

The communication line 5 is connected to a relay device 33 in a public network via an Internet service provider 32 who provides an email service for various types of information/data. The communication line 5 is an always-connected line.

The security device 1 is provided with a communication control unit 151. Further, the security device 1 is provided with a detection circuit 161 which operates so that in the event a user at the terminal device 4 does not acquire information indicating occurrence of an abnormality until a first predetermined time period has passed since the abnormality indicator data began to be sent, the detection circuit 161 detects this event and sends out a first detection signal and in the event the user does not acquire the information indicating occurrence of an abnormality until a second predetermined time period has passed since expiration of the first predetermined time period, the detection circuit detects this event and sends out a second detection signal. The fact that the user at the terminal device 4 acquires the information indicating occurrence of an abnormality is indicated by a signal generated when the email is opened by the user.

The security device 1 is provided with an alarm generation unit 17. The alarm generation unit 17 generates a first alarm indicating occurrence of an abnormality in response to a first detection signal and a second alarm which in response to a second detection signal, rings louder and indicates more distinctly the occurrence of an abnormality than the first alarm does. For instance, the first alarm at normal volume is used to inform people around the security device 1 of occurrence of an abnormality and the second alarm at high volume is used to inform people far from the security device 1 of occurrence of an abnormality.

The terminal device 4 is used by a user to acquire the information indicating occurrence of an abnormality and to prepare control data and then send the data to the security device 1 in order to address the abnormality. The security device 1 is provided with a control circuit 18 for instructing the camera 12 to begin imaging in response to reception of the control data by the security device 1. Further, in response to the control data, the control circuit 18, if necessary, causes the alarm generation unit 17 to generate an alarm.

Next, how the remote monitoring system according to the embodiment 2 of the invention operates will be explained with reference to a flow chart of FIG. 4. In step S21, the sensor 10 detects an abnormality and then in step S22, the abnormality indicator data generation circuit 141 generates, as abnormality indicator data, an email message (or email letter) in response to an instruction from the central processing unit 11. After generation of the abnormality indicator data, the abnormality indicator data is sent by email to the terminal device 4 via the line 5 in step S23. The terminal device 4 receives the abnormality indicator data in step S24. In step S25, it is determined whether or not the email containing the abnormality indicator data received has been opened. When the email is opened and a user acquires the information indicating occurrence of an abnormality in step S26, sending of the abnormality indicator data is stopped. Afterwards, the user sends from the terminal device 4 the control data on how to address the abnormality to the security device 1 in step S27. The security device 1 receives the control data in step S28. Then, the control circuit 18 enables the camera 12 to take the image of a location needing security in step S29. The image taken by the camera 12 is converted by the conversion circuit 13 to a digital image signal and sent to the terminal device 4 via the email support line 5. The user views an image reproduced from the digital image signal on the terminal device 4 and is able to recognize an abnormal situation. In this manner, the user acquires the information indicating occurrence of an abnormality and collected by the security device 1 and recognizes the abnormal situation, and therefore is able to address the abnormality.

When the email is not opened in step S25 and the detection circuit 161 determines the first predetermined time period has passed in step S30, the central processing unit 11 causes the alarm generation unit 17 to generate a first alarm in step S21. The first alarm at normal volume is used to inform people around the security device 1 of occurrence of an abnormality. In step S32, it is continuously determined by the detection circuit 161 whether or not the user opens the email until the first predetermined time period has passed. If this is the case, the detection circuit 161 detects the opening of the email and resets the time count of a timer to zero. The user acquires the information indicating occurrence of an abnormality from the email in step S26 and sends by email the control data in step S27. The security device 1 receives the control data in step S28. Then, the control circuit 18 causes the camera 12 to take the image of a location needing security in step S29. The image taken by the camera 12 is converted by the conversion circuit 13 to a digital image signal, which is again sent to the terminal device 4 via the email support line 5. The user views an image reproduced from the digital image signal on the terminal device 4 and is able to recognize an abnormal situation. If necessary, whether to allow the detection circuit 16 to continue or stop generating the first alarm is determined by the control data. In this manner, the user at the terminal device 4 acquires the information indicating occurrence of an abnormality and collected by the security device 1 and recognizes the abnormal situation, and therefore is able to address the abnormality.

When the detection circuit 16 detects that the email is not opened until the second predetermined time period has passed in step S33, the central processing circuit 11 causes the alarm generation unit 17 to generate a second alarm in step S34. The second alarm is intended to ring louder than the first alarm does and notify people far from the security device 1 of occurrence of an abnormality. Afterwards, sending of the email is continued and then terminated when the user opened the email and it is determined that the security device 1 has addressed the abnormality in step S35.

In the abovementioned embodiment 2, an abnormality can be monitored remotely so that the abnormality is detected by the sensor 10 of the security device 1 and abnormality indication data is sent by email to the terminal device 4. If the email is not opened at the terminal device 4 even after the first predetermined time period has passed since the security device began sending the email in response to occurrence of an abnormality, the alarm generation unit 17 of the security device 1 generates the first alarm in response to the first detection signal output from the detection circuit 161. Then, if the email is not opened even when the second predetermined time period has passed since expiration of the first predetermined time period, the detection circuit 161 detects this event and outputs the second detection signal. In response to the second detection signal, the alarm generation unit 17 generates a second alarm which in response to the second detection signal, rings louder and indicates more distinctly the occurrence of an abnormality than the first alarm does. In this manner, when the email is continuously sent to the terminal device 4 and not opened at the terminal device 4, the security device 1 generates an alarm to address the abnormality. In this case, an alarm can be such that the alarm increases in volume after a predetermined time period has passed and therefore is more effective for addressing the abnormality.

It should be appreciated that although in the embodiment 1 and embodiment 2 of the invention, the first alarm and second alarm are different in volume, those two alarms may be configured to deliver different voice messages. Further, the alarm is not limited to the voice message, but for example, may be delivered in various ways, including by emitting light.

Moreover, although in the embodiment 1 of the invention, the control data is sent by email from the terminal device 2 to the security device 1, the control data may be sent in such a manner that a user pushes appropriate buttons on the telephone 21 to select, as control data, any one of the instruction contents previously stored in the telephone and sends the control data.

What is claimed is:

1. A remote monitoring system for sending information indicating occurrence of an abnormality and collected by a security device to a predetermined terminal device, in order to remotely monitor whether or not there is an abnormal situation, the system comprising:

communication means for sending said information indicating occurrence of an abnormality from said security device to said terminal device via an email support line and a telephone line;

detection means for detecting that a user at said terminal device does not acquire said information indicating occurrence of an abnormality until a first predetermined time period has passed since said security device began sending said information indicating occurrence of an abnormality and sending out a first detection signal, and for detecting that the user at said terminal device does not acquire said information indicating occurrence of an abnormality until a second predetermined time period has passed since expiration of said first predetermined time period and sending out a second detection signal;

control means for allowing said communication means to provide said email support line until said first predetermined time period has passed since said information indicating occurrence of an abnormality began to be sent and to provide said telephone line in response to said first detection signal; and alarm generation means, provided in said security device, for generating a first alarm in response to the first detection signal and generating a second alarm, which rings louder than the first alarm does, in response to said second detection signal.

2. A remote monitoring system for sending information indicating occurrence of an abnormality and collected by a security device to a predetermined terminal device, in order to remotely monitor whether or not there is an abnormal situation, the system comprising:

communication means for sending an email containing said information indicating occurrence of an abnormality from said security device to said terminal device;

detection means for detecting that the email is not opened at said terminal device until a first predetermined time period has passed since said security device began sending said email and sending out a first detection signal, and for detecting that said email is not opened at said terminal device until a second predetermined time period has passed since expiration of said first predetermined time period and sending out a second detection signal; and alarm generation means, provided in said security device, for generating a first alarm in response to the first detection signal and generating a second alarm, which rings louder than the first alarm does, in response to said second detection signal.

3. A remote monitoring method for sending information indicating occurrence of an abnormality and collected by a security device to a predetermined terminal device, in order to remotely monitor whether or not there is an abnormal situation, the method comprising:

a step of sending an email containing said information indicating occurrence of an abnormality to said terminal device;

a step of determining whether or not said email is opened at said terminal device until a first predetermined time period has passed since said security device began sending said email;

a step of sending said information indicating occurrence of an abnormality to said terminal device via a telephone line in the event said email is not opened until said first predetermined time period has passed;

a step of allowing an alarm generation unit provided in said security device to generate a first alarm after said first predetermined time period has passed;

a step of determining whether or not the user acquires said information indicating occurrence of an abnormality and sent via said telephone line until a second predetermined time period has passed since expiration of said first predetermined time period; and a step of allowing said alarm generation unit to generate a second alarm, which rings louder than the first alarm does, in the event the user does not acquire said information indicating occurrence of an abnormality and sent via said telephone line until said second predetermined time period has passed.

4. A remote monitoring method for sending information indicating occurrence of an abnormality and collected by a security device to a predetermined terminal device, in order to remotely monitor whether or not there is an abnormal situation, the method comprising:

a step of sending an email containing said information indicating occurrence of an abnormality to said terminal device;

a step of determining whether or not said email is opened at said terminal device until a first predetermined time period has passed since said security device began sending said email;

a step of allowing an alarm generation unit provided in said security device to generate a first alarm after said first predetermined time period has passed in the event said email is not opened until said first predetermined time period has passed;

a step of determining whether or not said email is opened and then said information indicating occurrence of an abnormality is acquired by a user until a second predetermined time period has passed since expiration of said first predetermined time period; and a step of allowing said alarm generation unit to generate a second alarm, which rings louder than the first alarm does, in the event said email is not opened and said information indicating occurrence of an abnormality is not acquired by a user until said second predetermined time period has passed.

* * * * *